US007995013B2

(12) United States Patent
Mitomi et al.

(10) Patent No.: US 7,995,013 B2
(45) Date of Patent: Aug. 9, 2011

(54) DISPLAY APPARATUS HAVING A THRESHOLD VOLTAGE AND MOBILITY CORRECTING PERIOD AND METHOD FOR DRIVING THE SAME

(75) Inventors: Yutaka Mitomi, Kanagawa (JP); Yukihito Iida, Kanagawa (JP); Takao Tanikame, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 775 days.

(21) Appl. No.: 12/070,990

(22) Filed: Feb. 22, 2008

(65) Prior Publication Data

US 2008/0218454 A1 Sep. 11, 2008

(30) Foreign Application Priority Data

Mar. 9, 2007 (JP) ..... P2007-059405

(51) Int. Cl.
*G09G 3/32* (2006.01)

(52) U.S. Cl. ..... 345/82; 345/78

(58) Field of Classification Search ..... 345/76, 345/78, 82

See application file for complete search history.

(56) References Cited

U.S. PATENT DOCUMENTS

| | | | | |
|---|---|---|---|---|
| 5,684,365 | A | 11/1997 | Tang et al. | |
| 2005/0007357 | A1 * | 1/2005 | Yamashita et al. | 345/204 |
| 2005/0269959 | A1 * | 12/2005 | Uchino et al. | 315/169.3 |
| 2006/0061560 | A1 * | 3/2006 | Yamashita et al. | 345/204 |
| 2006/0114200 | A1 * | 6/2006 | Yamashita et al. | 345/77 |

FOREIGN PATENT DOCUMENTS

JP 08-234683 9/1996

* cited by examiner

*Primary Examiner* — Chanh Nguyen
*Assistant Examiner* — Long Pham
(74) *Attorney, Agent, or Firm* — Robert J. Depke; Rockey, Depke & Lyons, LLC

(57) ABSTRACT

In a display apparatus, as shown in FIG. 1, by using a reference signal, a shift register and a logical operation circuit generate a driving signal in periods for correcting a threshold voltage based on a rectangular wave signal. Also by using the reference signal, a write signal in a mobility correcting period is generated by an inverter, a NAND circuit, a level conversion circuit, a buffer circuit, a driving power generating unit, and a low-pass filter including a resistor and a capacitor. The signals are separately generated and are selectively output. Thus, excessive or insufficient mobility correction based on emission brightness can be prevented.

4 Claims, 10 Drawing Sheets

DISPLAY APPARATUS HAVING A THRESHOLD VOLTAGE AND MOBILITY CORRECTING PERIOD AND METHOD FOR DRIVING THE SAME

CROSS REFERENCES TO RELATED APPLICATIONS

The present invention contains subject matter related to Japanese Patent Application JP 2007-059405 filed in the Japanese Patent Office on Mar. 9, 2007, the entire contents of which are incorporated herein by reference.

BACKGROUND OF THE INVENTION

1. Field of the Invention

The present invention relates to a display apparatus and a method for driving the same, and can be applied to an active matrix display apparatus including organic electroluminescence (EL) elements using, for example, a polysilicon thin-film transistor (TFT). In an embodiment of the present invention, by separately generating a write signal in a threshold-voltage correcting period and a write signal in a mobility correcting period, and selectively outputting the write signals, excessive or insufficient mobility correction based on emission brightness, coupling noise, and variations in mobility correcting periods between scanning lines are prevented, and image quality deterioration due to variations in the characteristics of transistors included in pixel circuits can be effectively avoided.

2. Description of the Related Art

Hitherto, regarding display apparatuses using organic EL elements, various techniques have been proposed in, for example, U.S. Pat. No. 5,684,365, and Japanese Unexamined Patent Application Publication No. 8-234683.

In a display apparatus 1 of the above type, each pixel includes an organic EL element that is a current-driven light-emitting element and a pixel circuit for driving the organic EL element. As shown in FIG. 3, by arranging the pixels in a matrix, a pixel section 2 is formed. In the pixel section 2, scanning lines SCN are horizontally provided in units of lines for the pixels arranged in a matrix. In addition, signal lines SIG are provided in units of columns so as to be perpendicular to the scanning lines SCN.

A selector 4 sequentially transfers predetermined sampling pulses and uses the sampling pulses to sequentially latch image data D1, whereby the image data D1 is distributed to each signal line SIG. The selector 4 performs analog-to-digital conversion on the image data D1 distributed to the signal line SIG. This generates a driving signal that time-divisionally represents an emission brightness of each pixel. The selector 4 outputs the driving signal to a corresponding signal line SIG.

In response to driving of the signal line SIG by the selector 4, vertical scanners 3A and 3B generate driving signals for each pixel and output the driving signals to the scanning lines SCN. This allows the display apparatus 1 to use the vertical scanners 3A and 3B to sequentially drive the individual pixels arranged in the pixel section 2. Each pixel is allowed to emit light at a signal level of each signal line SIG which is set by the selector 4, whereby a desired image is displayed in the pixel section 2.

In the display apparatus 1 of the above type, by using polysilicon TFTs, the pixel section 2, the vertical scanners 3A and 3B, the selector 4, etc., are collectively formed on a transparent insulated substrate such as a glass substrate or the like.

The polysilicon TFT is not free from variations in threshold voltage and mobility. A display apparatus using the organic EL elements has a problem in that image quality deteriorates due to the variations.

In a method for solving this problem, by using, for example, the circuit configuration shown in FIG. 4 to form a pixel circuit, a threshold voltage of a driving transistor and variations in mobility can be corrected.

In other words, in a display apparatus 11, a pixel section 12 is formed by arranging pixels 13 in a matrix. In each pixel 13, one end of a signal-level-holding capacitor C1 is connected to an anode of an organic EL element 14. The other end of the signal-level-holding capacitor C1 is connected to the signal line SIG through a write transistor TR1 that is turned on and off in accordance with a write signal WS. Accordingly, in the pixel 13, in accordance with the write signal WS, a voltage at the other end of the signal-level-holding capacitor C1 is set as a signal level of the signal line SIG.

In the pixel 13, the ends of the signal-level-holding capacitor C1 are connected to the source and gate of a driving transistor TR2. The drain of the driving transistor TR2 is connected to one scanning line SCN for supplying power. This causes the pixel 13 to drive the organic EL element 14 by using the driving transistor TR2, which has a source-follower-circuit configuration having a gate voltage set to a signal level of the signal line SIG. Here, Vcat represents a cathode potential of the organic EL element 14, and a capacitance Cel is a capacitance of the organic EL element 14.

In the display apparatus 11, a first vertical scanner (WSCN) 16A outputs the write signal WS to one scanning line SCN, and a second vertical scanner (DSCN) 16B outputs a power-supply driving signal Vccp to one scanning line SCN. In addition, a selector (HSEL) 15A of a horizontal driving circuit 15 outputs a driving signal Ssig to the signal line SIG. This controls an operation of the pixel 13.

FIG. 5 is a time chart showing the operation of the pixel 13. In the pixel 13, during a light-emission period that is a period in which the organic EL element 14 is allowed to emit light, the write signal WS sets the write transistor TR1 to be in an off-state, and, on the basis of a driving signal Vccp, a power-supply voltage Vcc is supplied to the driving transistor TR2 (parts (A) and (B) of FIG. 5). Accordingly, in the pixel 13, a gate voltage Vg and source voltage Vs (parts (D) and (E) of FIG. 5) of the driving transistor TR2 are held as voltages at the ends of the signal-level-holding capacitor C1. The organic EL element 14 is driven by a driving current Ids based on the gate voltage Vg and the source voltage Vs.

In the pixel 13, when the light-emission period ends, on the basis of the driving signal Vccp, the drain voltage of the driving transistor TR2 falls to a predetermined voltage Vss. This voltage Vss is set to a low voltage sufficient to stop light emission of the organic EL element 14. Accordingly, in the pixel 13, an end of the driving transistor TR2 on the side of the driving signal Vccp serves as a source, and an anode voltage of the organic EL element 14 falls, so that the organic EL element 14 stops light emission. At this time, stored charge is discharged from the signal-level-holding capacitor C1 on the side of the organic EL element 14. This causes the anode voltage of the organic EL element 14 to fall and the anode voltage is set as the voltage Vss. In association of the fall in anode voltage, the gate voltage Vg of the driving transistor TR2 falls.

Subsequently, in a state in which, on the basis of the driving signal Ssig, the voltage of the signal line SIG is allowed to fall to a predetermined voltage Vofs, the write signal switches on the write transistor TR1 (parts (A) and (C) of FIG. 5). Accordingly, in the pixel 13, the gate voltage Vg of the driving voltage TR2 is set as the voltage Vofs of the signal line SIG, and a gate-source voltage Vgs of the driving transistor TR2 is set as Vofs-Vss. Here, when a threshold voltage of the driving transistor TR2 is represented by Vth, the voltage Vofs is set so that the gate-source voltage Vgs of the driving transistor TR2 is greater than the threshold voltage Vth of the driving transistor TR2.

Subsequently, during a period denoted by the reference mark Tth1, in a state in which the write transistor TR1 is maintained to be on, the driving signal Vccp causes the drain voltage of the driving transistor TR2 to rise to the power-supply voltage Vcc. Accordingly, in the pixel 13, a charging current flows at an end of the signal-level-holding capacitor C1 on the side of the organic EL element 14 on the basis of the power-supply voltage Vcc via the driving transistor TR2, so that the voltage Vs gradually increases at the end on the side of the organic EL element 14.

Subsequently, in the pixel 13, the write signal WS turns off the write transistor TR1. This allows the charging current based on the power-supply voltage Vcc via the driving transistor TR2 to flow into the end of the signal-level-holding capacitor C1 on the side of the organic EL element 14, so that the source voltage Vs of the driving transistor TR2 continues to increase. Also, in this case, the gate voltage Vg of the driving transistor TR2 increases, following an increase in the source voltage Vs.

After a predetermined time elapses, as denoted by the reference mark Tth2, in the pixel 13, the signal level of the signal line SIG is switched to the voltage Vofs again. In a state in which a potential of the signal-level-holding capacitor C1 on the side of the signal line SIG is maintained to the voltage Vofs, a charging current flows at the end of the signal-level-holding capacitor C1 on the side of the organic EL element 14 on the basis of the power-supply voltage Vcc via the driving transistor TR2, so that the source voltage Vs of the driving transistor TR2 gradually increases. Accordingly, in the pixel 13, the source voltage Vs of the driving transistor TR2 gradually increases so that the gate-source voltage Vgs of the driving transistor TR2 approaches the threshold voltage Vth of the driving transistor TR2. When the gate-source voltage Vg of the driving transistor TR2 reaches the threshold voltage Vth of the driving transistor TR2, the flow of the charging current via the driving transistor TR2 stops.

The inflow of the charging current to the end of the signal-level-holding capacitor C1 on the side of the organic EL element 14 via the driving transistor TR2 is repeated a number of times which is sufficient for the gate-source voltage Vgs of the driving transistor TR2 to reach the threshold voltage Vth of the driving transistor TR2 (in the example shown in FIG. 5, twice as denoted by the reference marks Tth1 and Tth2). This sets the threshold voltage Vth of the driving transistor TR2 in the signal-level-holding capacitor C1. In the pixel 13, the voltages Vofs and Vcat are set so that $Vel=Vofs-Vth \leqq Vcat+Vthel$ in a state in which the threshold voltage Vth of the driving transistor TR2 is set in the signal-level-holding capacitor C1. This sets the organic EL element 14 so as not to emit light. Here, Vthel represents a threshold voltage of the organic EL element 14.

After that, in the pixel 13, a potential of the signal-level-holding capacitor C1 on the side of the signal line SIG is set as a voltage Vsig representing an emission brightness of the organic EL element 14, whereby a gray-scale voltage is set in the signal-level-holding capacitor C1 so that the threshold voltage Vth of the driving transistor TR2 is canceled. This prevents variations in emission brightness caused by variations in the threshold voltage Vth of the driving transistor TR2.

In other words, in the pixel 13, after elapse of the period Tth2, the signal level of the signal line SIG is set to the signal level Vsig representing the emission brightness of the pixel 13. Subsequently, during a period Tμ, the write signal WS sets the write transistor TR1 to be in an on-state. Accordingly, in the pixel 13, an end of the signal-level-holding capacitor C1 on the side of the signal line SIG is set to have a signal level Vsig. A current in accordance with the gate-source voltage Vgs by an interterminal voltage of the signal-level-holding capacitor C1 flows from a power supply having the voltage Vcc into an end of the organic EL element 14 on the side of the signal-level-holding capacitor C1 through the driving transistor TR2. This causes the source voltage Vs of the driving transistor TR2 to gradually increase.

The current that flows through the driving transistor TR2 changes in accordance with mobility of the driving transistor TR2, whereby, as the mobility of the driving transistor TR2 increases, a rise speed of the source voltage Vs increases. In addition, the current of the driving transistor TR2 that drives the organic EL element 14 in the case of causing the organic EL element 14 to emit light increases in accordance with the mobility. The driving transistor TR2 of this type is a polysilicon TFT or amorphous transistor, and has a defect in that mobility, represented by μ, greatly varies.

Accordingly, in the pixel 13, during the period Tμ, in a state in which the voltage of the signal-level-holding capacitor C1 on the side of the signal line SIG is held at the signal level Vsig, the driving transistor TR2 is turned on, whereby a charging current flows into the end of the signal-level-holding capacitor C1 on the side of the organic EL element 14. This decreases the interterminal voltage of the signal-level-holding capacitor C1 for the mobility of the driving transistor TR2, and prevents variations in emission brightness caused by variations in the mobility of the driving transistor TR2.

In the pixel 13, after the predetermined period Tμ elapses, the write signal WS turns off the write transistor TR1, so that the signal level Vsig of the signal line SIG is set in the signal-level-holding capacitor C1, thus initiating an emission period.

According to the construction shown in FIGS. 4 and 5, a simplified pixel circuit configuration can prevent deterioration in image quality caused by variations in the threshold voltage Vth and mobility in the driving transistor TR2 that drives the organic EL element 14.

However, the construction shown in FIGS. 4 and 5 causes new problems. The write signal WS that determines the period Tμ is generated for each scanning line SCN in the vertical scanner 16A by using predetermined reference pulses. The generated write signal WS is input to each pixel 13 through a buffer circuit or the like. Therefore, on the basis of variations in a threshold voltage, mobility, etc., of a transistor provided up to the pixel 13, as shown in FIG. 6, a phase, transient, etc., of the write signal WS vary. As a result, in the display apparatus 11, a problem occurs in that a brightness level difference is generated between lines since the period Tμ for correcting mobility varies between lines. The brightness level difference between lines is viewed as a stripe, for example, on a dark display screen.

In addition, when the signal level of the write signal WS rapidly falls from a high level to a low level, a problem occurs in that coupling noise caused by parasitic capacitance of the write transistor TR1 is displayed.

In the period Tμ for correcting mobility, the current Ids that flows in the driving transistor TR2 changes in accordance with the gate-source voltage of the driving transistor TR2, whereby, as the signal level Vsig of the signal line SIG is greater, that is, as the organic EL element 14 is allowed to emit light at a high brightness level, a large current flows, so that a voltage rise speed at the end of the signal-level-holding capacitor C1 on the side of the organic EL element 14 increases. Therefore, as the organic EL element 14 is allowed to emit light at a high brightness level, variations in mobility can be corrected in a short time. Conversely, when the signal Vsig of the signal line SIG is low, that is, when the organic EL element 14 is allowed to emit light at a low brightness level, the voltage rise speed at the end of the signal-level-holding capacitor C1 on the side of the organic EL element 14 decreases, and a time necessary for mobility correction increases.

Accordingly, in the construction in FIGS. 4 and 5, the mobility of the driving transistor TR2 is excessively corrected in accordance with the emission brightness of the organic EL element 14, or the correction is insufficient. Consequently, image quality deteriorates, and, in addition, a problem occurs in that a yield deteriorates.

As a method for solving the new problems, it is possible that a final stage of a vertical scanner for outputting the write signal WS be configured as shown in FIG. 7. Specifically, by connecting, in stages, pairs of P-channel transistors and N-channel transistors, a buffer circuit 21 in an output stage of the write signal WS is formed. As shown in FIG. 8, parts (A) to (C), a voltage of power Vws that is supplied to a pair of transistors TR3 and TR4 is allowed to fall temporarily on the side of a terminating end of the period Tμ for correcting mobility. The temporary voltage falling is gradually executed.

FIG. 9 is a block diagram showing a vertical scanner including the configuration of the buffer circuit 21. The vertical scanner 22 shown in FIG. 9 has a configuration for one scanning line SCN. The vertical scanner 22 uses a shift register (not shown) to sequentially transfer vertical start pulses synchronized with a vertical synchronizing signal, and generates, for each scanning line SCN, a reference signal IN that is used as a basis for timing of the write signal WS that is output to the scanning line SCN. The vertical scanner 22 inputs the reference signal IN to a shift register (SR) 23 and generates a delay signal that is delayed for predetermined clocks. The vertical scanner 22 inputs a timing-based driving signal or the signal IN, the delay signal, and various reference signals EN1 and DVth to a logical operation circuit 24. As shown in part (A) of FIG. 10, logical operation processing in the logical operation circuit 24 generates a first driving signal S1 whose logic level falls in the periods Tth1 and Tth2 correcting the threshold voltage Vth.

The vertical scanner 22 inputs an inversion signal of the driving signal IN, the delay signal, and a predetermined reference signal EN2 to a NAND circuit 26. The NAND circuit 26 generates an inversion signal of an AND signal of these signals, whereby, as shown in part (B) of FIG. 10, a second driving signal S2 whose logic level falls in the mobility correcting period Tμ is generated.

The vertical scanner 22 uses a NAND circuit 27 to generate an inversion signal of an AND signal of the first and second driving signals S1 and S2, and inputs the inversion signal to the buffer circuit 21 sequentially through a buffer circuit 28 and a level conversion circuit 29. The level conversion circuit 29 is provided to convert an amplitude of an output signal into an amplitude adapted for driving the organic EL element 14. Accordingly, as shown in part (C) of FIG. 10, the vertical scanner 22 generates a third driving signal S3 whose logic level rises in the mobility correcting period Tμ.

In the vertical scanner 22 shown in FIG. 9, regarding power Vws that is supplied to a pair of transistors in the final stage of the buffer circuit 21, a voltage is allowed to fall temporarily at a terminating end of the mobility correcting period Tμ. By gradually executing the temporary voltage falling, as shown in part (D) of FIG. 10, the write signal WS is allowed to rise in level in the periods Tth1 and Tth2 for correcting the threshold value Vth and the mobility correcting period Tμ. In addition, the signal level is allowed to gradually fall at the terminating end of the correcting period Tμ. Therefore, in the display apparatus 11, as the signal level Vsig of the signal line SIG increases, the write transistor TR1 can be turned off at an early time. Accordingly, correction of variations in the mobility can be finished and excessive or insufficient mobility correction based on the emission brightness can be prevented. In addition, since the signal level of the write signal WS is gradual, also coupling noise can be prevented. However, even in this method, it is difficult to completely prevent variations in the period Tμ for correcting mobility between lines.

As shown in parts (A1) to (C1) in FIG. 8 in comparison with (A) to (C) in FIG. 8, a method is possible in which, by supplying a power-supply voltage to the pair of transistors in the final stage of the buffer circuit 21 only during the periods Tth1 and Tth2 for correcting the threshold value Vth and the mobility correcting period Tμ, variations in the mobility correcting period Tμ are limited in a predetermined period on the basis of a change in power-supply voltage. In other words, in the case of this method, as shown in FIG. 11 in comparison with FIG. 7, by supplying power to the pair of transistors in the final stage via a low-pass filter including, for example, a resistor R and a capacitor C, rising and falling edges of the write signal WS in the mobility correcting period Tμ are made gradual, and the mobility correcting period Tμ can be set on the basis of a driving signal Vws that is input to the low-pass filter. Therefore, variations in the mobility correcting period Tμ between the scanning lines SCN can be reduced. In addition, excessive or insufficient mobility correction based on emission brightness can be prevented, and, in addition, coupling noise can be prevented.

However, this method has a problem in that, not only the mobility correcting period Tμ, but also the period Tth for correcting the threshold voltage Vth of the driving transistor TR1 has gradual rising and falling edges of a signal level. As described above, when even the period Tth for correcting the threshold voltage Vth has gradual rising and falling edges of a signal level, power consumption increases.

SUMMARY OF THE INVENTION

The present invention has been made in view of the above-described circumstances. It is desirable to provide a display apparatus and a display apparatus driving method that effectively avoid image quality deterioration based on variations in the characteristics of transistors included in pixel circuits by preventing excessive or insufficient mobility correction based on emission brightness, coupling noise, and variations in periods for correcting mobility between scanning lines.

According to an embodiment of the present invention, there is provided a display apparatus including a pixel section having pixels arranged in a matrix, and a horizontal driving circuit and a vertical driving circuit configured to drive signal lines and scanning lines in the pixel section, whereby an image is displayed in the pixel section, wherein each pixel includes a light-emitting element, a signal-level-holding capacitor, a write transistor configured to be turned on and off by a write signal output from the vertical driving circuit, and configured to set a terminal voltage of the signal-level-holding capacitor to a signal level of one signal line, and a driving transistor having a gate and a source to which ends of the signal-level-holding capacitor are connected, the driving transistor being configured to cause the light-emitting element to emit light by driving the light-emitting element in accordance with a voltage across the gate and source of the driving transistor, wherein, in a threshold voltage correcting period in a non-emission period in which light emission by the light-emitting element is stopped, after the write signal turns on the write transistor to set potentials at ends of the signal-level-holding capacitor to predetermined potentials, a threshold voltage of the driving transistor is set in the signal-level-holding capacitor by discharging stored charge of the signal-level-holding capacitor through the driving transistor, wherein, in a mobility correcting period in the non-emission period in which the light emission by the light-emitting element is stopped, the mobility correcting period following the threshold voltage correcting period, after the write signal turns on the write transistor to set a voltage at one end of the signal-level-holding capacitor to the signal level of the one signal line, the driving transistor charges the other end of the signal-level-holding capacitor by turning on the driving transistor, wherein a fall of the write signal turns off the write transistor, and wherein the vertical driving circuit includes a threshold-voltage-correcting-period write-signal generating unit configured to generate the write signal in the threshold voltage correcting period, a mobility-correcting-period write-signal generating unit configured to generate the write signal in the mobility correcting period, and a selective output unit configured to selectively output, to the pixel, the write signal in the threshold voltage correcting period and the write signal in the mobility correcting period.

According to another embodiment of the present invention, there is provided a driving method for a display apparatus which includes a pixel section having pixels arranged in a matrix, and a horizontal driving circuit and a vertical driving circuit configured to drive signal lines and scanning lines in the pixel section, whereby an image is displayed in the pixel section, in which each pixel includes a light-emitting element, a signal-level-holding capacitor, a write transistor configured to be turned on and off by a write signal output from the vertical driving circuit, and configured to set a terminal voltage of the signal-level-holding capacitor to a signal level of one signal line, and a driving transistor having a gate and a source to which ends of the signal-level-holding capacitor are connected, the driving transistor being configured to cause the light-emitting element to emit light by driving the light-emitting element in accordance with a voltage across the gate and source of the driving transistor, in which, in a threshold voltage correcting period in a non-emission period in which light emission by the light-emitting element is stopped, after the write signal turns on the write transistor to set potentials at ends of the signal-level-holding capacitor to predetermined potentials, a threshold voltage of the driving transistor is set in the signal-level-holding capacitor by discharging stored charge of the signal-level-holding capacitor through the driving transistor, in which, in a mobility correcting period in the non-emission period in which the light emission by the light-emitting element is stopped, the mobility correcting period following the threshold voltage correcting period, after the write signal turns on the write transistor to set a voltage at one end of the signal-level-holding capacitor to the signal level of the one signal line, the driving transistor charges the other end of the signal-level-holding capacitor by turning on the driving transistor, and in which a fall of the write signal turns off the write transistor, the driving method including the steps of generating the write signal in the threshold voltage correcting period and the write signal in the mobility correcting period, and selectively outputting, to the pixel, the write signal in the threshold voltage correcting period and the write signal in the mobility correcting period.

According to the embodiments of the present invention, in correcting variations in a threshold voltage and variations in mobility, a write signal in a threshold-voltage correcting period and a write signal in a mobility correcting period are generated. Only the write signal in the mobility correcting period can be smoothed without smoothing the write signal in the threshold-voltage correcting period. Therefore, excessive or insufficient mobility correction based on emission brightness can be prevented, and, in addition, coupling noise can be prevented. Since the write signal in the mobility correcting period can be generated separately from the write signal in the threshold-voltage correcting period, the write signal in the mobility correcting period can be generated omitting complicated logical operation processing, and, by suppressing the influence of variations in various characteristics of transistors concerning the logical operation processing, the write signal in the mobility correcting period can be accurately generated. Therefore, variations in the correcting period between scanning lines can be prevented. These can effectively avoid image quality deterioration caused by variations in the characteristics of transistors included in pixel circuits.

According to the embodiments of the present invention, excessive or insufficient mobility correction based on emission brightness, coupling noise, and variations in a mobility correcting period between scanning lines are prevented, whereby image quality deterioration caused by variations in the characteristics of transistors included in pixel circuits can be effectively avoided. Therefore, a high uniformity image can be displayed.

DESCRIPTION OF THE PREFERRED EMBODIMENTS

Embodiments of the present invention will be described below with reference to the accompanying drawings, if necessary.

First Embodiment

Figure 1:
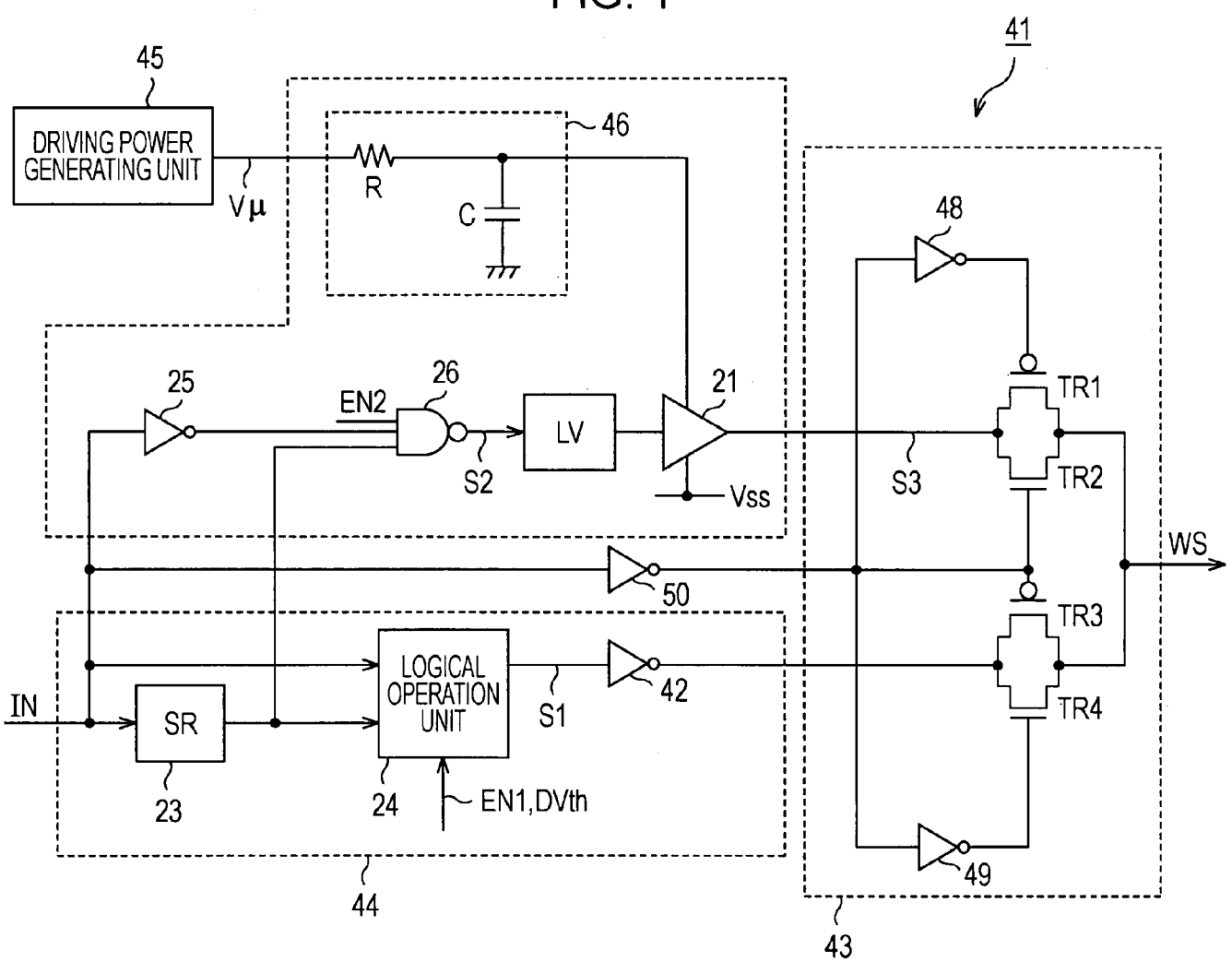
FIG. 1 is a block diagram showing a part of the configuration of a vertical scanner applied to a display apparatus according to an embodiment of the present invention.
Figure 9:
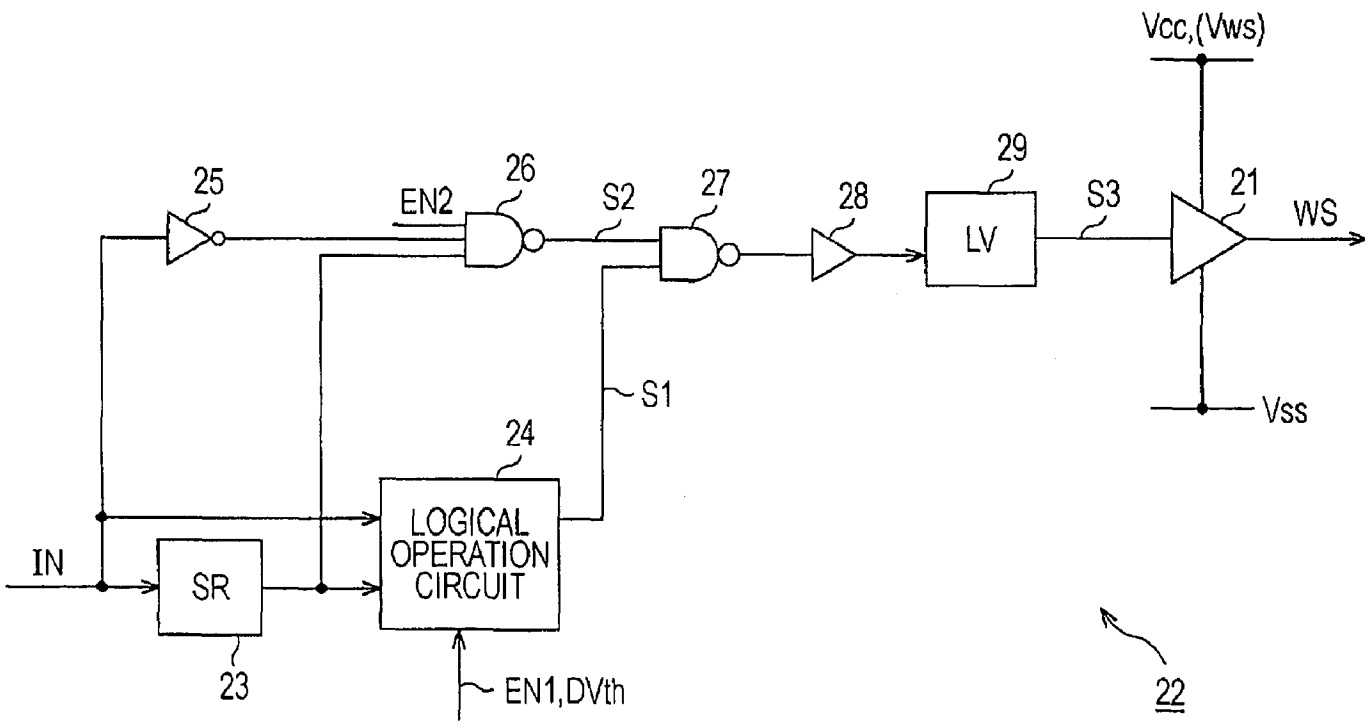
FIG. 9 (PRIOR ART)
FIG. 9 is a block diagram showing a part of the configuration of a vertical scanner including the buffer circuit shown in FIG. 7.
Figure 10:
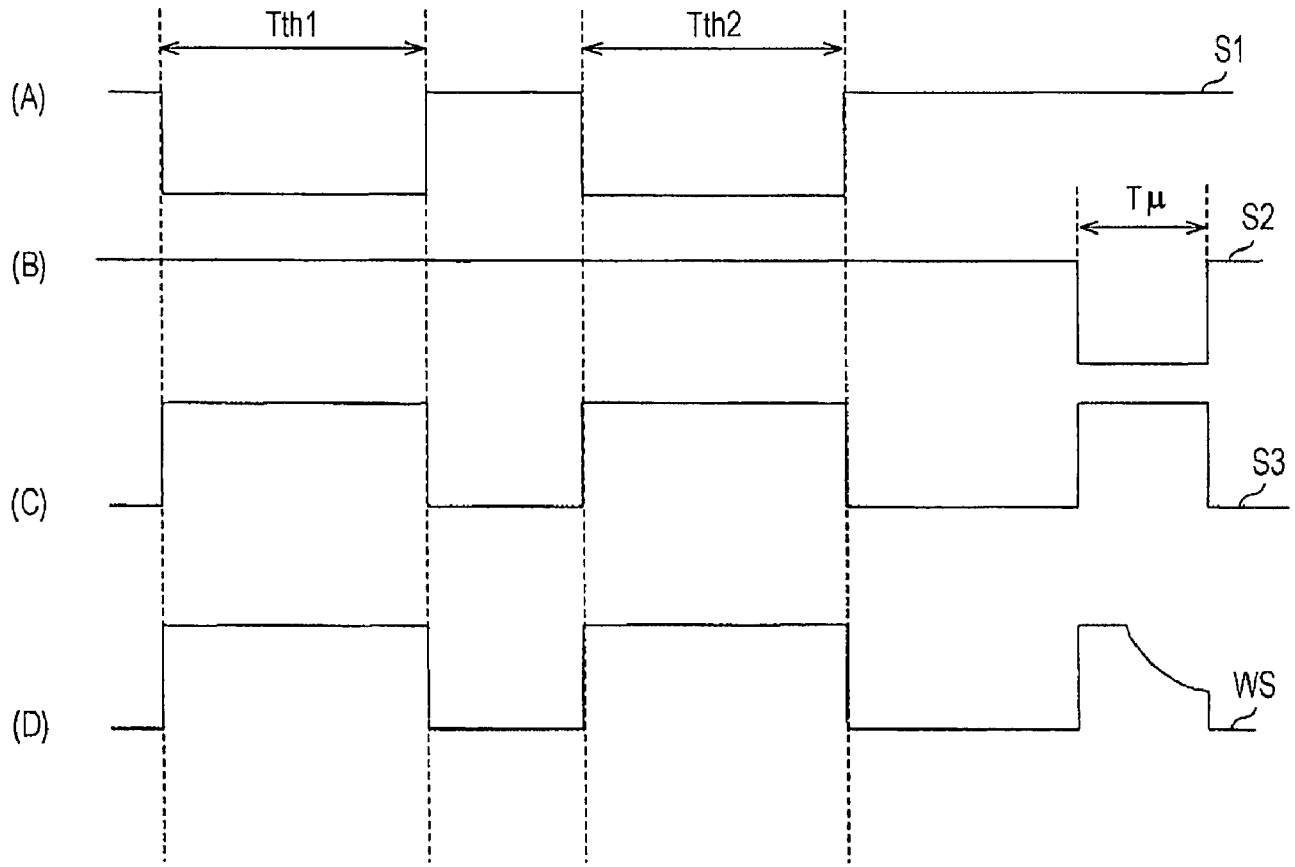
FIG. 10 (PRIOR ART)
FIG. 10 is a time chart of the vertical scanner shown in FIG. 9.

FIG. 1 is a block diagram showing, on the basis of comparison with FIG. 9, the configuration of a vertical scanner 41 for one scanning line which is applied to a display apparatus according to a first embodiment of the present invention. The display apparatus according to this embodiment is identical in configuration to that shown in FIGS. 4 and 5 except that the configuration of the vertical scanner 41 differs. In the configuration of FIG. 1, portions identical to those shown in FIG. 9 are denoted by identical reference numerals.

Similarly to the vertical scanner 22 described with reference to FIG. 9, the vertical scanner 41 uses a shift register (not shown) to transfer vertical start pulses synchronized with a vertical synchronizing signal, and generates, for each scanning line SCN, a reference signal IN that is used as a basis for timing of a write signal WS that is output to the scanning line SCN. The vertical scanner 41 generates a delay signal by inputting the reference signal IN to a shift register (SR) 23. The vertical scanner 41 inputs the delay signal and various reference signals EN1 and DVth to a logical operation circuit 24. As shown in part (A) of FIG. 2, the logical operation circuit 24 generates a first driving signal S1 whose logic level falls in periods Tth1 and Tth2 for correcting a threshold voltage Vth. The vertical scanner 41 outputs the driving signal S1 to a multiplexer 43 through an inverter 42. Accordingly, in the vertical scanner 41, the shift register 23, the logical operation circuit 24, and the inverter 42 form a threshold-voltage-correcting-period write signal generator 44 for generating the write signal WS in a threshold-voltage correcting period.

In addition, the scanner 41 inputs, to a NAND circuit 26, an inversion signal of the reference signal IN through an inverter 25. The scanner 41 also inputs the delay signal and a predetermined reference signal EN2 to the NAND circuit 26. The NAND circuit 26 generates an inversion signal of an AND signal of these signals, whereby, as shown in part (B) of FIG. 2, a selection signal S2 whose logic level falls in a predetermined period including the mobility correcting period Tμ. The vertical scanner 41 inputs the selection signal S2 to the buffer circuit 21 through the level conversion circuit 29.

In this display apparatus, by sequentially transferring vertical start pulses, the reference signal IN is generated, and, on the basis of the reference signal IN, the first driving signal S1 and the selection signal S2 are generated. Thus, by using sequential scanning lines, the periods Tth1 and Tth2 for correcting the threshold voltage Vth, and the mobility correcting period Tμ are shifted for a predetermined shift period, whereby the write signal WS is generated.

In this display apparatus, a driving power generating unit 45 generates a rectangular wave signal whose signal level rises in the mobility correcting period Tμ in common to all the scanning lines SCN provided in a pixel section. The driving power generating unit 45 also generates driving power Vμ whose voltage varies depending on a signal level of the rectangular wave signal. Therefore, the driving power Vμ repeatedly rises in mobility correcting periods Tμ, with the shift period provided therebetween.

Figure 7:
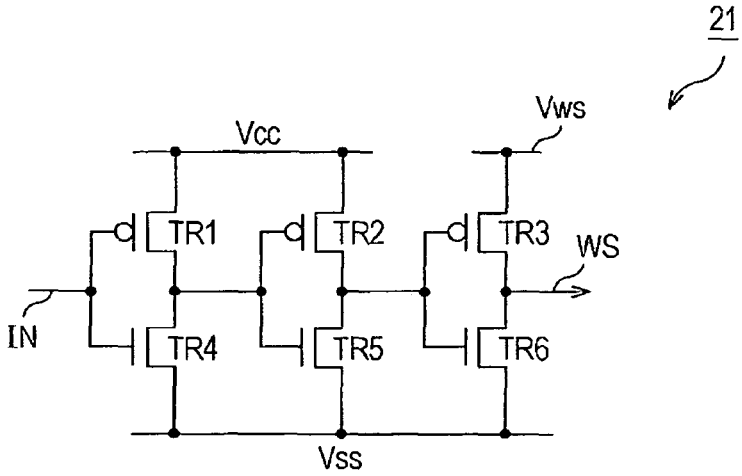
FIG. 7 (PRIOR ART)
FIG. 7 is a circuit diagram showing a buffer circuit.
Figure 8:
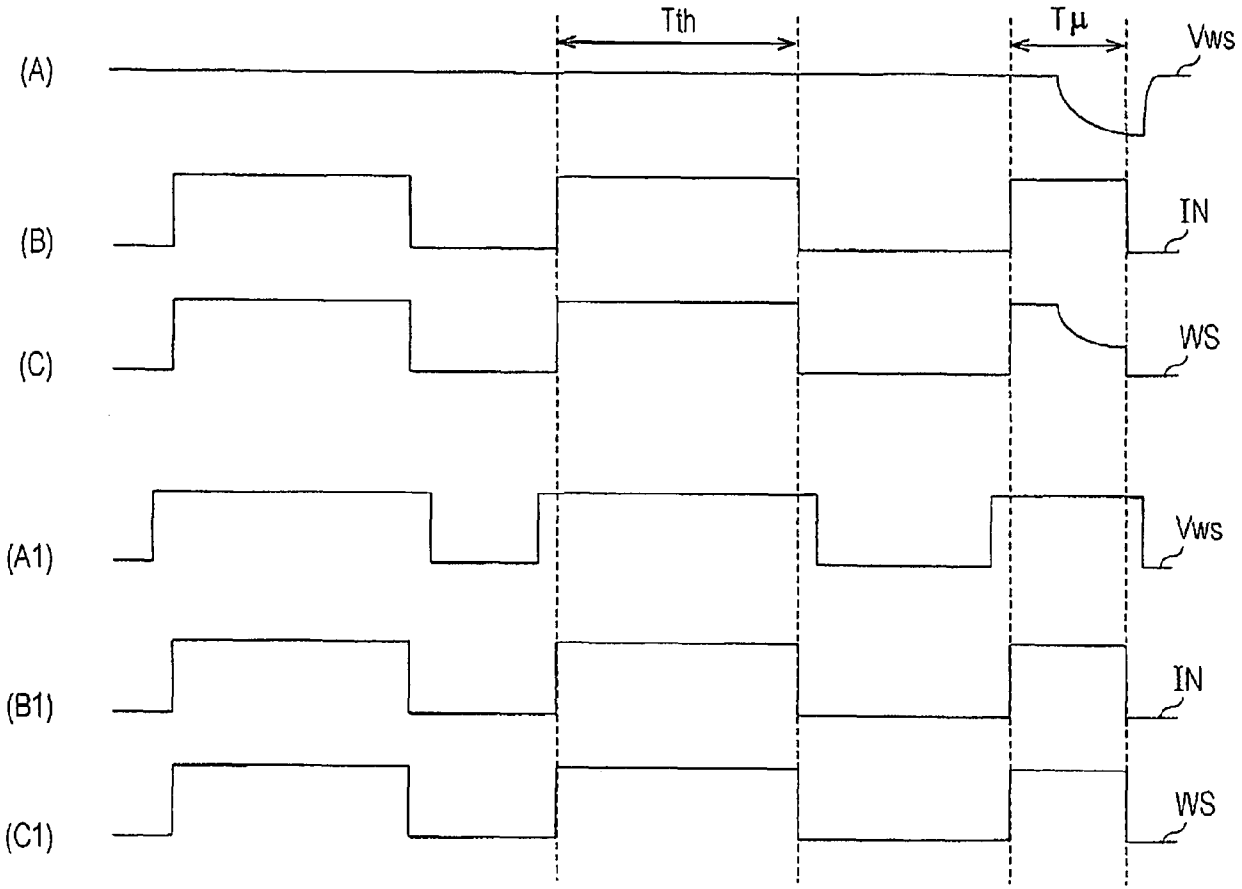
FIG. 8 (PRIOR ART)
FIG. 8 is a time chart showing the buffer circuit shown in FIG. 7.

The vertical scanner 41 inputs the driving power Vμ to a low-pass filter including a resistor R and a capacitor C. The vertical scanner 41 smooths rising and falling edges of the driving power Vμ. On the basis of a signal waveform corresponding to the write signal in the mobility correcting period, power for a buffer circuit 21 is supplied. The buffer circuit 21 is formed by connecting, in a plurality of stages, pairs of P-channel transistors and N-channel transistors (see FIG. 7). Driving power output from this low-pass filter is supplied to a pair of transistors in the final stage.

Figure 2:
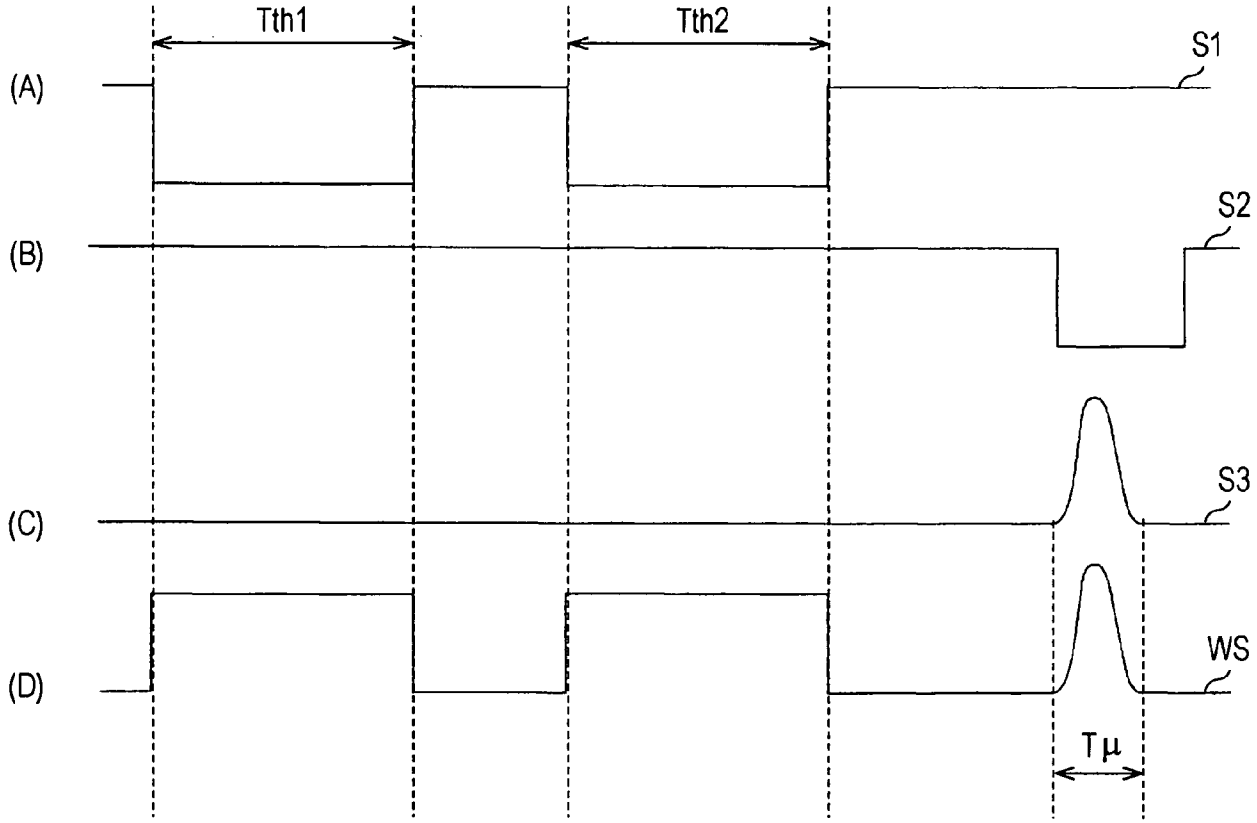
FIG. 2 is a time chart of the vertical scanner shown in FIG. 1.
Figure 3:
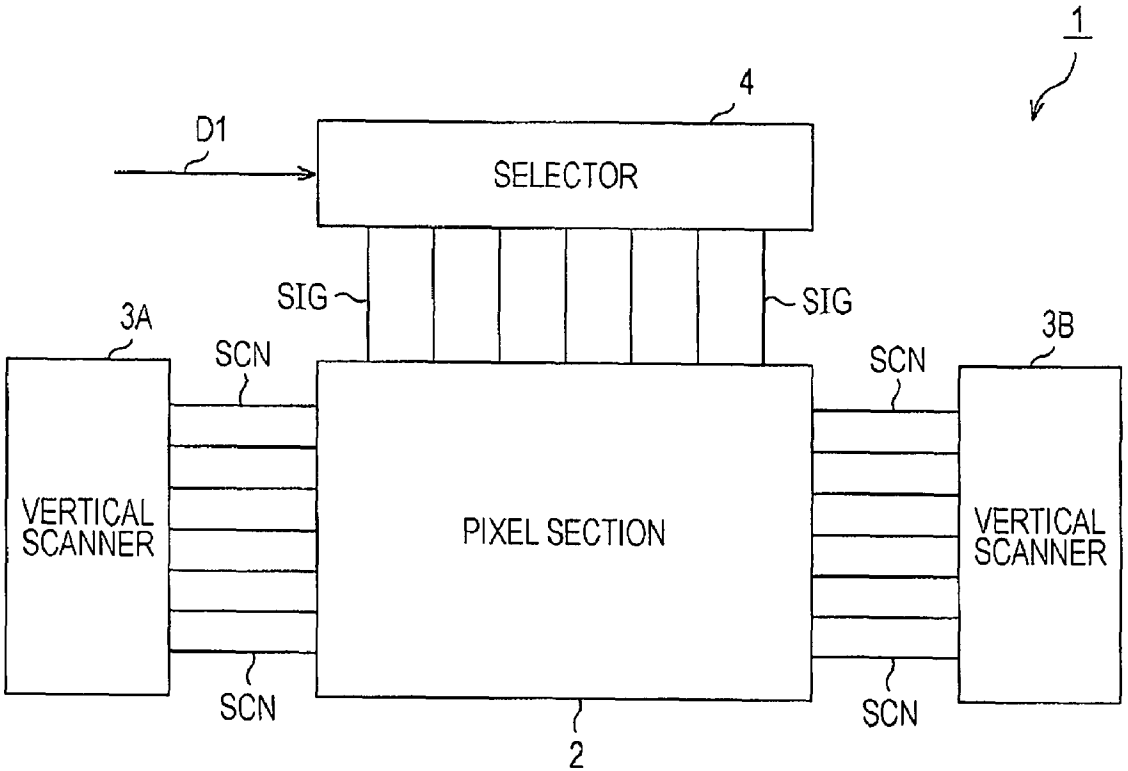
FIG. 3 (PRIOR ART)
FIG. 3 is a block diagram showing a display apparatus of the related art.

As shown in part (C) of FIG. 2, by using a signal waveform of the driving power Vμ to change a signal level at an output end during a period in which the selection signal S2 falls in the buffer circuit 21, the vertical scanner 41 outputs a mobility-correcting-period write signal S3.

The vertical scanner 41 outputs an output signal S3 of the buffer circuit 21 to a multiplexer 43. As shown in part (D) of FIG. 2, the multiplexer 43 is a selection circuit that selectively outputs the output signal S3 of the buffer circuit 21 and an output signal of an inverter 42. The vertical scanner 41 outputs, as the write signal WS, an output signal of the multiplexer 43.

In other words, the multiplexer 43 includes a first switching circuit including a P-channel transistor TR1 and an N-channel transistor TR2, and a second switching circuit including a P-channel transistor TR3 and an N-channel transistor TR4. An inversion signal of the reference signal IN is input to gates of the transistors TR2 and TR3 through an inverter 50. The inversion signal is input to the transistors TR1 and TR4 through inverters 48 and 49. This complementarily turns on and off the first and second switching circuits on the basis of the reference signal IN. By adding the output signals of the first and second switching circuits, the multiplexer 43 outputs the write signal WS.

Operation of Embodiment

In the above-described configuration, in the display apparatus according to the embodiment (see FIGS. 4 and 5), a signal level Vsig of a signal line SIG is sequentially set in each pixel 13 in a pixel section 12 in units of lines by driving of the signal line SIG and the scanning line SCN by a selector 15A, and vertical scanners 16A and 16B. In addition, an organic EL element in the pixel 13 emits light on the basis of the set signal level, whereby a desired image is displayed in the pixel section 12.

In other words, in the display apparatus, in a non-emission period, one end of a signal-level-holding capacitor C1 is set to have a signal level Vsig of the signal line SIG. In an emission period, an organic EL element 14 is driven by a transistor TR2 on the basis of a gate-source voltage Vgs based on an interterminal voltage of the signal-level-holding capacitor C1. Accordingly, in the display apparatus, the organic EL element 14 of each pixel 13 emits light at an emission brightness based on the signal level Vsig of the signal line SIG.

In the display apparatus, in the non-emission period, in a state in which supply of power to the driving transistor TR2 is stopped, the write signal WS sets the transistor TR1 to be on, and the voltages of ends of the signal-level-holding capacitor C1 are set to predetermined potentials Vofs and Vss. After that, by performing discharge through the driving transistor TR2, a threshold voltage Vth of the driving transistor TR2 is set (in FIG. 5, periods Tth1 and Tth2) in the signal-level-holding capacitor C1. This corrects variations in emission brightness based on variations in the threshold voltage Vth of the driving transistor TR2.

In addition, after that, the write signal WS sets the transistor TR1 to be on. An end of the signal-level-holding capacitor C1 on the side of the signal line SIG is set to have a signal level Vsig of the signal line SIG, and the driving transistor TR2 charges the other end of the signal-level-holding capacitor C1 (in FIG. 5, period Tμ). This corrects variations in emission brightness based on variations in mobility of the driving transistor TR2.

In the display apparatus, after the mobility correcting period Tμ elapses, the write signal WS switches the transistor TR1 to an off-state. This allows the signal-level-holding capacitor C1 to sample and hold the signal level Vsig of the signal line C1, whereby the emission brightness of the organic EL element 14 is set.

Accordingly, the periods Tth1 and Tth2 for correcting the threshold voltage Vth, and the mobility correcting period Tμ are determined on the basis of the write signal WS. If the timing of the write signal WS changes for each scanning line, a brightness level difference between lines is generated to cause deterioration in image quality. If the signal level of the write signal WS rapidly falls from H level to L level, coupling noise is displayed due to parasitic capacitance of the write transistor TR1. In addition, in the mobility correcting period Tμ, the driving transistor TR2 changes, on the basis of a gate-source voltage of the driving transistor TR2, a current Ids that is input to an end of the signal-level-holding capacitor C1 on the side of the organic EL element 14. Thus, as the organic EL element 14 is allowed to emit light at a higher brightness level, a large current flows to increase a voltage rise speed at an end of the signal-level-holding capacitor C1 on the side of the organic EL element 14. Therefore, on the basis of the voltage Vsig set in the signal-level-holding capacitor C1, that is, on the basis of the emission brightness of the organic EL element 14, excessive or insufficient correction of the mobility of the driving transistor TR2 occurs.

Accordingly, in the display apparatus (FIG. 1), by sequentially transferring vertical start pulses, the reference signal IN is generated which is a timing basis for the write signal WS that is output to each scanning line SCN. By using the reference signal IN, the shift register 23 and the logical operation circuit 24 generate the driving signal S1 in the periods for correcting the threshold voltage Vth based on a rectangular wave signal. In addition, on the basis of the reference signal IN, by the inverter 25, the NAND circuit 26, the level conversion circuit 29, the buffer circuit 21, the driving power generating unit 45, and the low-pass filter including a resistor R and a capacitor C, the write signal S3 in the mobility correcting period is generated. The driving signal S1 in the periods Tth1 and Tth2 for correcting the threshold voltage Vth, and the write signal S3 in the mobility correcting period Tμ are selectively output through the multiplexer 43.

In the display apparatus, the driving signal S1 in the periods Tth1 and Tth2 for correcting the threshold voltage Vth, and the write signal S3 in the mobility correcting period Tμ are separately generated and are selectively output. Thus, only the write signal S3 in the mobility correcting period Tμ can be smoothed without smoothing the driving signal S1 in the periods Tth1 and Tth2 for correcting the threshold voltage Vth. This can prevent excessive or insufficient mobility correction based on emission brightness, and can further prevent coupling noise.

In addition, the write signal S3 in the mobility correcting period Tμ is generated separately from the driving signal S1 in the threshold value correcting periods Tth1 and Tth2. Thus, the write signal S3 in the mobility correcting period Tμ can be generated omitting complicated logical operation processing. Accordingly, the influence of variations in various characteristics of transistors for logical operation processing, etc., can be suppressed, and the write signal S3 in the mobility correcting period Tμ can be accurately generated. These can effectively avoid image quality deterioration caused by variations in the characteristics of transistors included in pixel circuits.

In actuality, in the display apparatus according to the embodiment, the inverter 25, the NAND circuit 26, and the level conversion circuit 29 generate the selection signal S2. The driving power generating unit 45 generates the driving power Vμ in common to all the scanning lines SCN. After the driving power Vμ is smoothed by the low-pass filter including the resistor R and the capacitor C, the write signal S3 in the mobility correcting period Tμ is generated on the basis of selective output with the selection signal S2 by the buffer circuit 21. Thus, variations in the write signal S3 between the scanning lines SCN are generated only in the low-pass filter, the buffer circuit 21, and the multiplexer 43. In addition, in the buffer circuit 21, only a pair of transistors in the final stage influences the variations. This can reduce variations in a mobility correcting period between the scanning lines SCN. These can effectively avoid image quality deterioration caused by variations in the characteristics of transistors included in the pixel circuits.

Accordingly, also regarding the low-pass filter, by using all the scanning lines SCN in common, variations in the mobility correcting period can be further reduced.

Figure 11:
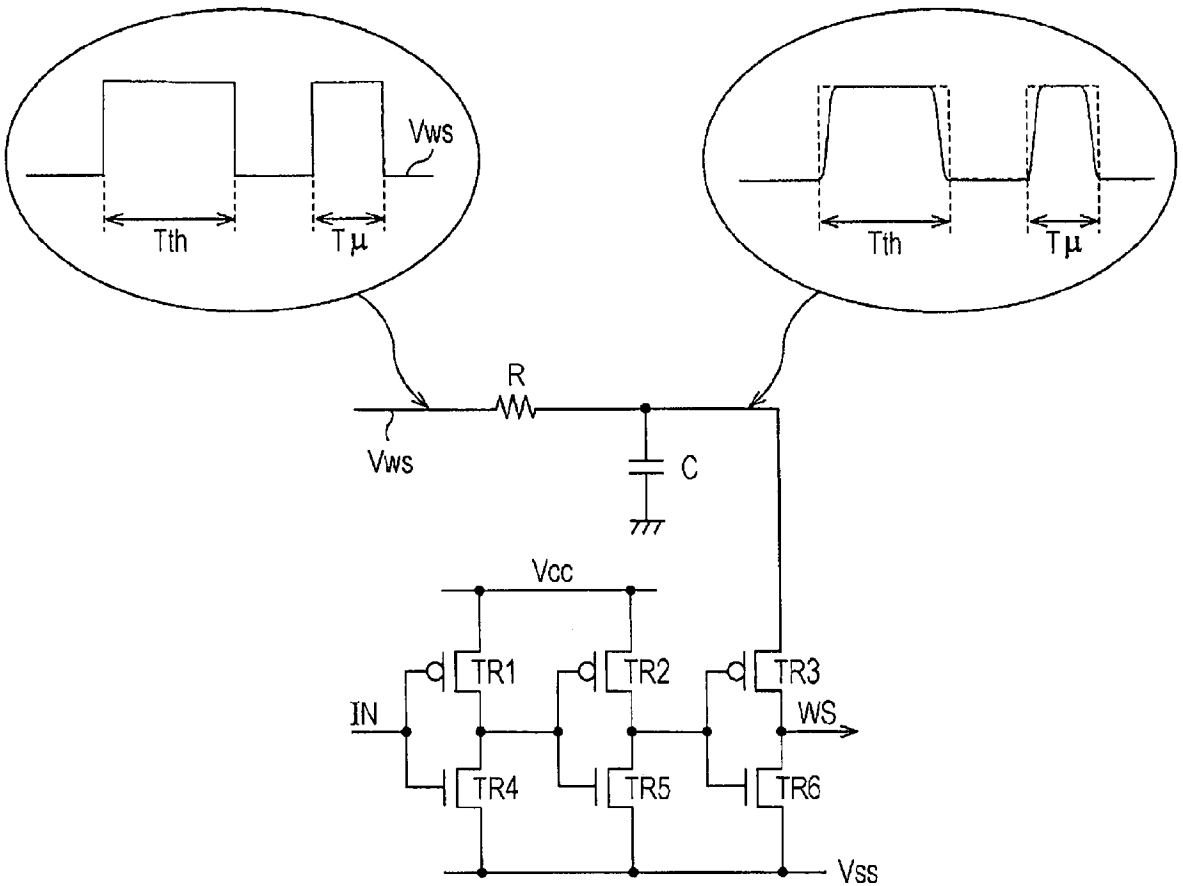
FIG. 11 (PRIOR ART)
FIG. 11 is a circuit diagram showing a buffer circuit configuration different from that of the buffer circuit shown in FIG. 7.

In addition, in this case, regarding the write signal WS in the threshold voltage correcting period, the signal waveform is not smoothed at all, whereby power consumption can be greatly reduced compared with a case (see FIG. 11) in which the write signal WS is smoothed, including a write signal in a threshold value correcting period.

Advantages of Embodiment

According to the above configuration, by separately generating a write signal in a threshold-voltage correcting period and a write signal in a mobility correcting period, and selectively outputting the write signals, excessive or insufficient mobility correction based on emission brightness, coupling noise, and variations in the mobility correcting period between scanning lines can be prevented. Thus, image quality deterioration based on variations in the characteristics of transistors included in pixel circuits can be effectively avoided. Therefore, a high uniformity image can be displayed.

More specifically, by using a rectangular wave signal to generate a write signal in a threshold-voltage correcting period, and generating a write signal in a mobility correcting period while smoothing rising and falling edges of the signal level, excessive or insufficient mobility correction based on emission brightness, coupling noise, and variations in the mobility correcting period between scanning lines can be prevented. Therefore, image quality deterioration caused by variations in the characteristics of transistors included in the pixel circuits can be effectively avoided.

In addition, by generating a selection signal corresponding to the write signal in the mobility correcting period, inputting the selection signal to the buffer circuit, and driving the buffer circuit by using a signal waveform corresponding to the write signal in the mobility correcting period, the write signal for the mobility correcting period is generated. This reduces variations in the mobility correcting period between scanning lines.

Second Embodiment

Figure 4:
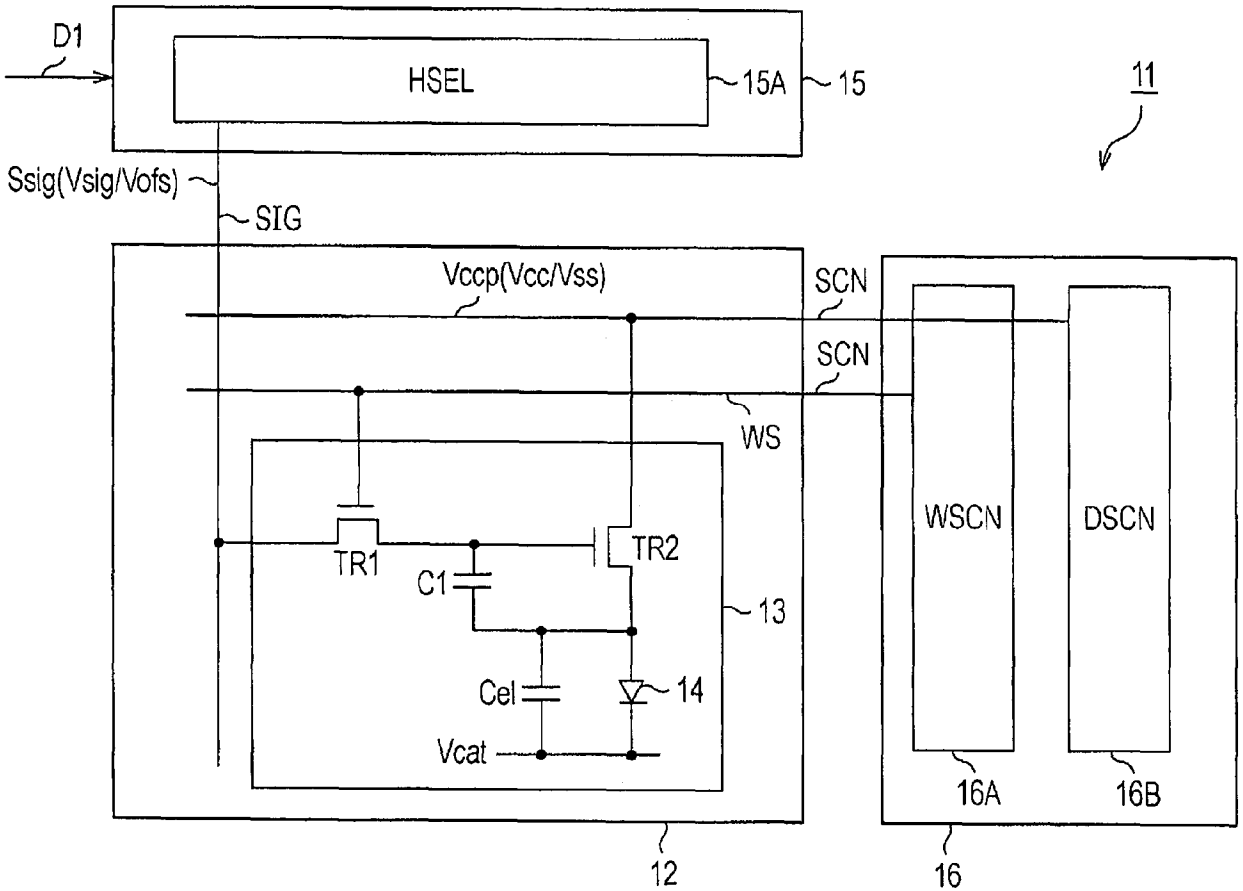
FIG. 4 (PRIOR ART)
FIG. 4 is a circuit diagram showing a pixel circuit in the display apparatus of the related art.
Figure 5:
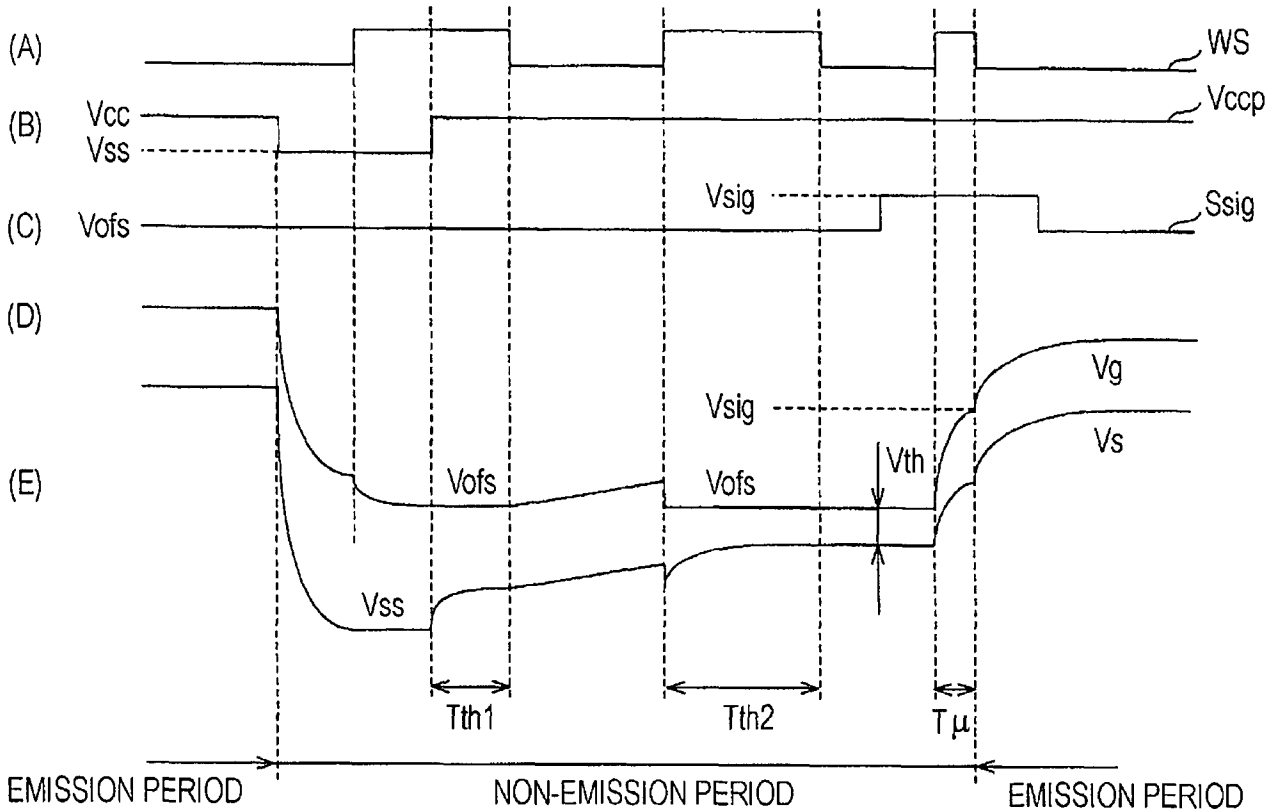
FIG. 5 (PRIOR ART)
FIG. 5 is a timing chart of the pixel circuit shown in FIG. 4.
Figure 6:
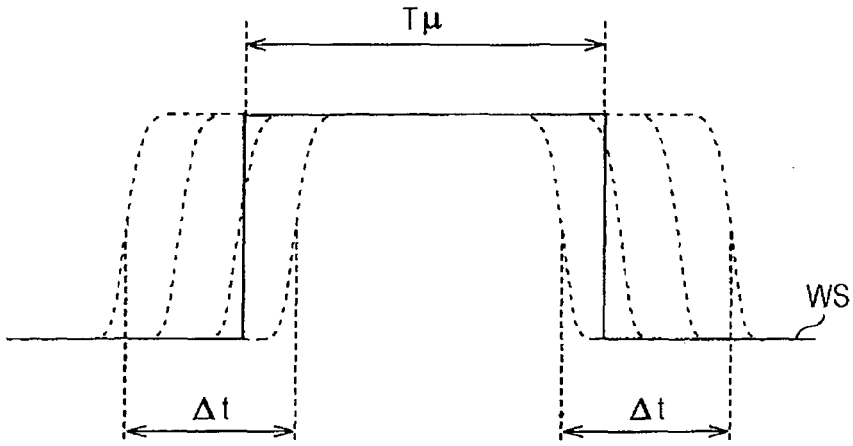
FIG. 6 (PRIOR ART)
FIG. 6 is a signal waveform chart showing variations in a mobility correcting period between scanning lines.

Although the first embodiment describes a case in which the pixel circuit shown in the circuit configuration shown in FIG. 4 is driven with the timing shown in FIG. 5, the present invention is not limited thereto. The present invention is widely applicable to cases such as when pixels are formed in various circuit configurations, and when pixels are driven at various timings.

Although the first embodiment describes a case in which rising and falling edges of a write signal level are smoothed, the present invention is not limited thereto. If practically sufficient characteristics are provided, one of rising and falling edges of the signal level may be smoothed.

Although the first embodiment describes a case in which each transistor is formed by a polysilicon TFT or amorphous transistor, the present invention is not limited thereto, and can be widely applied to cases in which various types of transistors are used.

Although the first embodiment describes a case in which a signal-level-holding capacitor is connected to a signal line by using an N-channel transistor, the present invention is not limited thereto, and can be widely applied to cases in which the signal-level-holding capacitor is connected to the signal line by using a P-channel transistor.

Although the first embodiment describes a case in which an organic EL element is used as a light-emitting element, the present invention is not limited thereto, and can be widely applied to cases in which various current-driven light-emitting elements are used.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus comprising:

a pixel section having pixels arranged in a matrix; and a horizontal driving circuit and a vertical driving circuit configured to drive signal lines and scanning lines in the pixel section, whereby an image is displayed in the pixel section, wherein each pixel includes a light-emitting element, a signal-level-holding capacitor, a write transistor configured to be turned on and off by a write signal output from the vertical driving circuit, and configured to set a terminal voltage of the signal-level-holding capacitor to a signal level of one signal line, and a driving transistor having a gate and a source to which ends of the signal-level-holding capacitor are connected, the driving transistor being configured to cause the light-emitting element to emit light by driving the light-emitting element in accordance with a voltage across the gate and source of the driving transistor, wherein, in a threshold voltage correcting period in a non-emission period in which light emission by the light-emitting element is stopped, after the write signal turns on the write transistor to set potentials at ends of the signal-level-holding capacitor to predetermined potentials, a threshold voltage of the driving transistor is set in the signal-level-holding capacitor by discharging stored charge of the signal-level-holding capacitor through the driving transistor, wherein, in a mobility correcting period in the non-emission period in which the light emission by the light-emitting element is stopped, the mobility correcting period following the threshold voltage correcting period, after the write signal turns on the write transistor to set a voltage at one end of the signal-level-holding capacitor to the signal level of the one signal line, the driving transistor charges the other end of the signal-level-holding capacitor by turning on the driving transistor, wherein a fall of the write signal turns off the write transistor, and wherein the vertical driving circuit includes a threshold-voltage-correcting-period write-signal generating unit configured to generate the write signal in the threshold voltage correcting period, a mobility-correcting-period write-signal generating unit configured to generate the write signal in the mobility correcting period, and a selective output unit configured to selectively output, to the pixel, the write signal in the threshold voltage correcting period and the write signal in the mobility correcting period.

2. The display apparatus according to claim 1, wherein the threshold-voltage-correcting-period write-signal generating unit generates the write signal in the threshold voltage correcting period by using a rectangular wave signal, and wherein the mobility-correcting-period write-signal generating unit generates the write signal in the mobility correcting period by smoothing a rising edge and/or falling edge of a signal level.

3. The display apparatus according to claim 2, wherein the mobility-correcting-period write-signal generating unit includes a selection-signal generating unit configured to generate a selection signal corresponding to the write signal in the mobility correcting period, a buffer circuit configured to receive the selection signal and to output an output signal, and a power-supply-voltage control circuit configured to change a power-supply voltage of the buffer circuit on the basis of a signal waveform corresponding to the write signal in the mobility correcting period, wherein the write signal in the mobility correcting period is generated by the buffer circuit on the basis of a change in the power-supply voltage by using the power-supply-voltage control circuit.

4. A driving method for a display apparatus which includes a pixel section having pixels arranged in a matrix, and a horizontal driving circuit and a vertical driving circuit configured to drive signal lines and scanning lines in the pixel section, whereby an image is displayed in the pixel section, in which each pixel includes a light-emitting element, a signal-level-holding capacitor, a write transistor configured to be turned on and off by a write signal output from the vertical driving circuit, and configured to set a terminal voltage of the signal-level-holding capacitor to a signal level of one signal line, and a driving transistor having a gate and a source to which ends of the signal-level-holding capacitor are connected, the driving transistor being configured to cause the light-emitting element to emit light by driving the light-emitting element in accordance with a voltage across the gate and source of the driving transistor, in which, in a threshold voltage correcting period in a non-emission period in which light emission by the light-emitting element is stopped, after the write signal turns on the write transistor to set potentials at ends of the signal-level-holding capacitor to predetermined potentials, a threshold voltage of the driving transistor is set in the signal-level-holding capacitor by discharging stored charge of the signal-level-holding capacitor through the driving transistor, in which, in a mobility correcting period in the non-emission period in which the light emission by the light-emitting element is stopped, the mobility correcting period following the threshold voltage correcting period, after the write signal turns on the write transistor to set a voltage at one end of the signal-level-holding capacitor to the signal level of the one signal line, the driving transistor charges the other end of the signal-level-holding capacitor by turning on the driving transistor, and in which a fall of the write signal turns off the write transistor, the driving method comprising the steps of:

generating the write signal in the threshold voltage correcting period and the write signal in the mobility correcting period; and selectively outputting, to the pixel, the write signal in the threshold voltage correcting period and the write signal in the mobility correcting period.

* * * * *